United States Patent [19]

Kuwabara

[11] 4,146,803

[45] Mar. 27, 1979

[54] FIRE-RESPONSIVE CONTROL DEVICE UTILIZING THYRISTORS

[75] Inventor: Katsutoshi Kuwabara, Tokyo, Japan

[73] Assignee: Hochiki Corporation, Tokyo, Japan

[21] Appl. No.: 823,180

[22] Filed: Aug. 8, 1977

Related U.S. Application Data

[63] Continuation-in-part of Ser. No. 810,004, Jun. 24, 1977, abandoned.

[51] Int. Cl.[2] ..... G08B 17/00

[52] U.S. Cl. ..... 307/308; 307/252 J; 307/252 M; 328/1; 328/3; 328/6; 340/628; 361/160

[58] Field of Search ..... 340/227 R; 307/252 F, 307/252 J, 252 M, 252 W, 308; 328/3, 6, 1

[56] References Cited

U.S. PATENT DOCUMENTS

| | | | |
|---|---|---|---|
| 3,286,185 | 11/1966 | Gilbert | 328/6 |
| 3,299,288 | 1/1967 | McDowell et al. | 307/252 J |

*Primary Examiner*—John Zazworsky

*Attorney, Agent, or Firm*—Haseltine, Lake & Waters

[57] ABSTRACT

In a thyristor fire-responsive control device including a fire detector which has a thyristor as output switching means, a control circuit is responsive to the detector. A controlled apparatus is responsive to the detector through the control circuit for fire preventing operation thereof. A oscillator is connected to periodically reset the thyristor of the detector. Delay means is connected to continue the energization of the controlled apparatus for a predetermined interval after each transient resetting of the thyristor so that said controlled apparatus can operate continuously only during an interval in which the detector persists in its detecting operation.

8 Claims, 4 Drawing Figures

FIRE-RESPONSIVE CONTROL DEVICE UTILIZING THYRISTORS

BACKGROUND OF THE INVENTION

The present application is a continuation-in-part of the parent application Ser. No. 810,004 filed June 24, 1977, now abandoned.

This invention relates to a control device and more particularly to a fire-responsive control device which utilizes a thyristor of a fire detector, as the control element for providing an ON-OFF control of a controlled apparatus.

Although thyristor has higher power rating than a transistor, when connected in a DC circuit, once the thyristor is turned ON it is impossible to turn it OFF by merely removing a control signal from a gate electrode thereof. Accordingly, it is necessary to interrupt the thyristor from the DC circuit for the purpose of deenergizing the controlled apparatus.

SUMMARY OF THE INVENTION

Accordingly, it is an object of this invention to provide an improved fire-responsive control device utilizing a thyristor as an output switching element of a fire-detector and can operate a controlled apparatus continuously only during an interval in which the detector persists in its detecting operation.

Another object of this invention is to provide an improved fire-responsive control device wherein the thyristor is used for controlling the energization of the controlled apparatus and the thyristor is intermittently turned OFF but the energization of the controlled apparatus is continuously effected in spite of the intermittent operation of the thyristor until a detected signal of the detector is removed from the gate electrode of the thyristor.

According to the present invention there is provided a thyristor fire-responsive control device comprising a fire detector, a control circuit responsive to said detector, a controlled apparatus, and a DC source, wherein said detector has an output stage including a thyristor arranged to receive a trigger signal to turn on the thyristor when the detector responds to a physical phenomenon caused by fire, the switching path of said thyristor being included in a current path including said DC source, wherein said control circuit includes an oscillator which is arranged to be controlled by the current in said current path so as to begin to oscillate upon ignition of said thyristor and arranged periodically to actuate means for transiently turning off said thyristor, wherein said controlled apparatus is controlled in accordance with the current in said current path so as to become energized wherein said thyristor is conductive, and wherein delay means are provided for maintaining the energization of said controlled apparatus for a predetermined interval after each transient suppression of current in said thyristor from the DC source.

According to a modified embodiment of this invention, the thyristor is connected in series with a relay across a DC source, and an oscillator and a controlled apparatus are connected in parallel across the DC source through the contact of the relay. A first capacitor is connected in parallel with the controlled apparatus so that energization of the apparatus is continued after opening of the relay contact until the capacitor discharges completely. The oscillator intermittently operates another relay having a normally closed contact connected in the charging circuit of a second capacitor and normally open contact connected in the discharge circuit of the second capacitor. The thyristor is connected in the discharge circuit of the second capacitor so that the thyristor is turned OFF when the second capacitor discharges. In this manner, the thyristor is turned ON and OFF alternately so long as the trigger signal is being impressed upon the gate electrode of the thyristor, and the controlled apparatus is continuously maintained in the energized condition by the first capacitor irrespectively of the ON-OFF control of the thyristor provided by the oscillator so long as the detector persists in its detecting operation.

BRIEF DESCRIPTION OF THE DRAWINGS

The invention can be more fully understood from the following detailed description taken in conjunction with the accompanying drawings in which.

DESCRIPTION OF THE PREFERRED EMBODIMENTS

Figure 1:
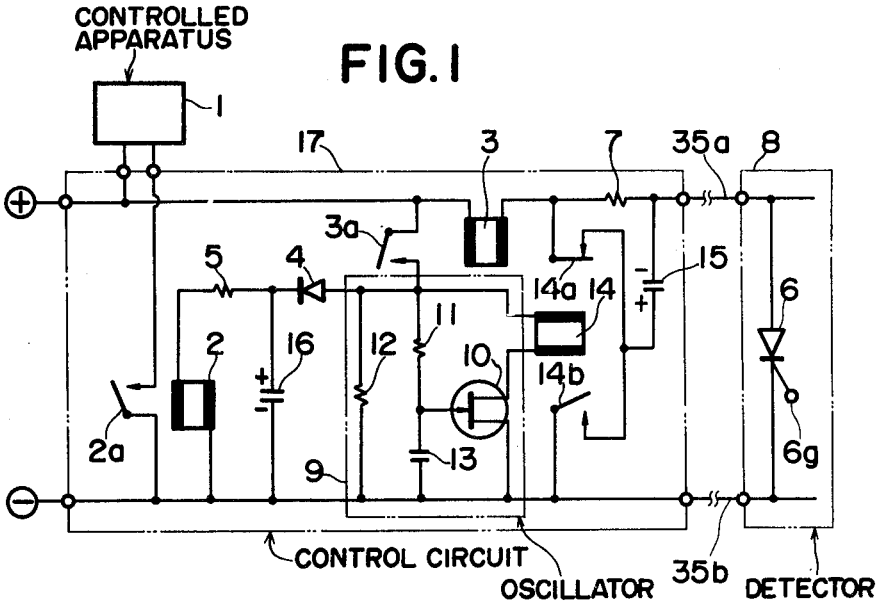
FIG. 1 shows a connection diagram of an embodiment of this invention.

Referring now to FIG. 1 of the accompanying drawing which shows a basic construction of the fire-responsive device of this invention, apparatus to be controlled such as a fire preventing door or a smoke exhaust device is designated by numeral 1 and its control relay and its contact are designated by numeral 2 and 2a respectively, and this relay 2 is connected across the DC source indicated by plus and minus symbols in series with the contact 3a of a relay 3, a diode 4 and a resistor 5, whereas a thyristor 6 is connected across the DC source in series with the relay 3 and a resistor 7.

Numeral 8 denotes a fire detector such as a heat detector, a photoelectric type smoke or flame detector or an ionization type smoke detector, and this fire detector comprises a detecting stage which produces a trigger signal when a change of surrounding physical phenomenon is caused by fire and output stage provided with said thyristor 6 which is turned ON and produces an output signal when the gate electrode 6g of the thyristor 6 receives said trigger signal. Such fire detector has been proposed, as in U.S. Pat. No. 3,710,365, for example.

An oscillator 9 is connected in parallel with a series circuit consisting of the diode 4, the resistor 5 and the relay 2, and the oscillator 9 comprises unijunction transistor 10, resistors 11 and 12 and a capacitor 13. Another relay 14 is connected with the oscillator 9 as a load of the transistor 10 of the oscillator.

The relay 14 is provided with a normally closed contact 14a and a normally open contact 14b. Serially connected contacts 14a and 14b are connected in parallel with a series circuit including resistor 7 and thyristor 6. A capacitor 15 is connected across the junction between contacts 14a and 14b, and the junction between resistor 7 and thyristor 6. Another capacitor 16 is connected in parallel with a series circuit including resistor 5 and relay 2.

In the figure, numeral 17 denotes a control circuit including these relays 2, 3 and 14, the oscillator 9 and capacitors 15, 16 and the circuit 17 is connected with the detector 8 by a pair of DC source-signal lines 35*a*, 35*b*.

The arrangement shown in FIG. 1 operates as follows:

When the detector 8 responds to a physical phenomenon caused by fire, and detected signal from the detector 8 is impressed upon the gate electrode 6*g* of the thyristor 6 as a trigger signal, the thyristor is turned ON to pass current through relay 3, resistor 7 and thyristor 6. Accordingly, the capacitor 15 is charged in the polarity shown by the current flowing through contact 14*a*, capacitor 15 and thyristor 6. Energization of relay 3 closes its contact 3*a* so that currents flow through a circuit including contact 3*a* and oscillator 9 and a circuit including diode 4, resistor 5 and relay 2. As a result, the relay 2 is energized to close its contact 2*a* upon completion of the charging of capacitor 16 and the controlled apparatus 1 is energized simultaneously but the oscillator 9 initiates oscillation at once.

As described above, the relay 14 is energized intermittently by the output from the transistor 10 of oscillator 9, thus alternately opening the contact 14*a* and closing the contact 14*b* and vice versa. When the contact 14*a* is opened and the contact 14*b* is closed, the capacitor 15 discharges through a discharge circuit including contact 14*b* and thyristor 6, thus turning OFF the thyristor. On the other hand, when the contact 14*a* is closed and the contact 14*b* is opened, the capacitor 15 is charged as described above for preparing the next turn OFF of the thyristor 6. Upon turning OFF thyristor 6, relay 3 is deenergized to open contact 3*a* thereby deenergizing the oscillator 9.

Although the relay 2 is also disconnected from the DC source, it will be still maintained in the energized state until the capacitor 16 completely discharges thus maintaining energization of the controlled apparatus 1. When the contact 14*b* of relay 14 is opened as a result of the deenergization of oscillator 9, because the source voltage is impressed across the anode and cathode electrodes of the thyristor 6, it is turned ON again provided that the detected signal is impressed upon its gate electrode 6*g*, whereby relay 3 becomes energized. Then contact 3*a* is reclosed and the cycle of operation described above is repeated. When the detected signal to the gate electrode 6*g* of the thyristor 6 terminates, the thyristor 6 is maintained OFF and the relay 2 and the controlled apparatus 1 are deenergized after completion of the discharge of the capacitor 16.

Figure 2:
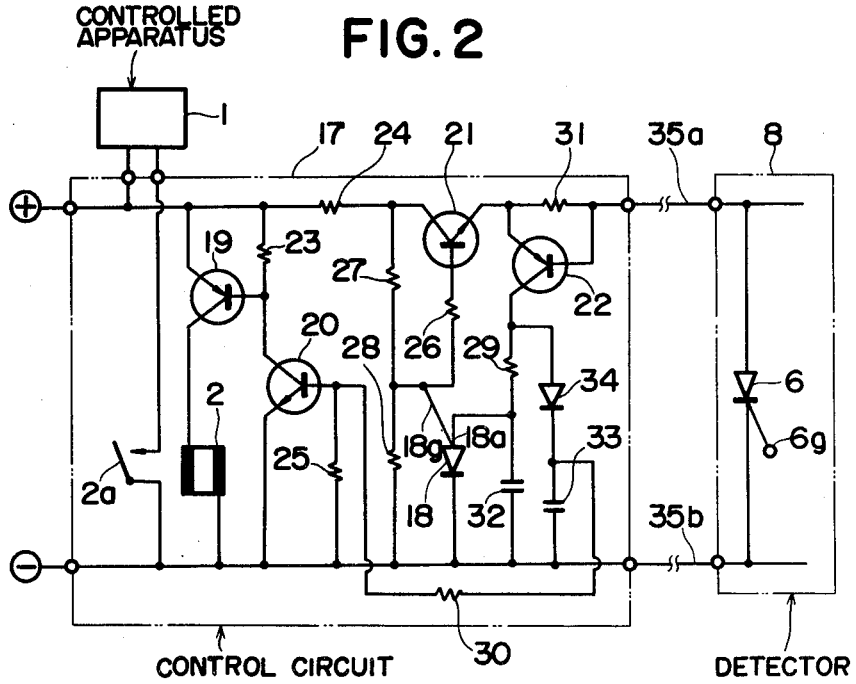
FIGS. 2 and 3 show connection diagrams of modified embodiments of this invention.

FIG. 2 shows a modification wherein a PUT oscillator is used as the reset oscillator. In this example, the control circuit 17 comprises a programmable unijunction transistor (PUT) 18 and in addition to component elements designated by the same reference numerals as in FIG. 1, transistors 19 through 22, resistors 23 through 31, capacitors 32 and 33 and a diode 34 are used. Although the relay 2 which controls the controlled apparatus 1 is controlled by the transistors 19 and 20, it will be possible to control the apparatus 1 directly by the transistor 19 as a substitute for the relay 2 when the apparatus consists of light load.

The circuit shown in FIG. 2 operates as follows:

When a detected signal of the detector 8 is impressed upon the gate electrode 6*g* of thyristor 6, the thyristor is turned ON to pass current from a source of DC through a circuit including resistor 24, transistor 21, resistor 31 and thyristor 6. When the thyristor turns ON, since the base electrode of transistor 22 is connected to the negative pole of the DC source through the thyristor, the transistor 22 turns ON to charge capacitor 33 through a circuit including resistor 24, the collector-emitter circuit of transistor 21, the emitter-collector circuit of transistor 22 and diode 34.

Further, positive voltage is applied to the anode electrode 8*a* of the programmable unijunction transistor 18 through resistor 24, the collector-emitter circuit of transistor 21, the emitter-collector circuit of transistor 22 and resistor 29. The capacitor 33 is charged, its terminal voltage is impressed upon the base electrode of transistor 20 through resistor 30, thus turning on transistor 20. Accordingly, transistor 19 is turned ON thus energizing the relay 2 and the controlled apparatus 1. Further, when transistor 22 turns ON, capacitor 32 is charged through resistor 29 and when the terminal voltage across capacitor 32, which is applied to the anode electrode 18*a* of the programable unijunction transistor 18 reaches a predetermined value, this transistor 18 is turned ON to discharge capacitor 32.

Then resistor 28 which is connected to the base of the transistor 21 is short circuited by programmable unijunction transistor 18, and transistor 21 is turned OFF, which in turn deenergizes thyristor 6. Upon completion of the discharge of capacitor 32, the programmable unijunction transistor 18 is turned OFF thus turning ON transistor 21.

As a result, thyristor 6 becomes again conductive, provided that the detected signal is still being impressed upon its gate electrode 6*g*, and the operation described above is repeated. Upon termination of the detected signal to the gate electrode 6*g*, the thyristor 6 becomes OFF and the relay 2 and the controlled apparatus 1 will be deenergized when capacitor 33 discharges completely through resistor 30 and resistor 25, thereby rendering OFF transistors 20 and 19.

It can be noted that capacitor 33 is connected to the emitter-collector circuit of transistor 22 through low resistance diode 34 whereas capacitor 32 is connected through a resistor 29 so that capacitor 33 is charged up earlier than capacitor 32.

Accordingly, the relay 2 and the controlled apparatus 1 is energized before turning ON of the programmable unijunction transistor 18 and hence turning OFF of transistor 21. Accordingly, controlled apparatus will be maintained in the energized state until capacitor 32 is completely discharged. However, if the detected signal still persists, thyristor 6 and hence transistor 22 are turned ON again for charging capacitors 32 and 33.

Figure 3:
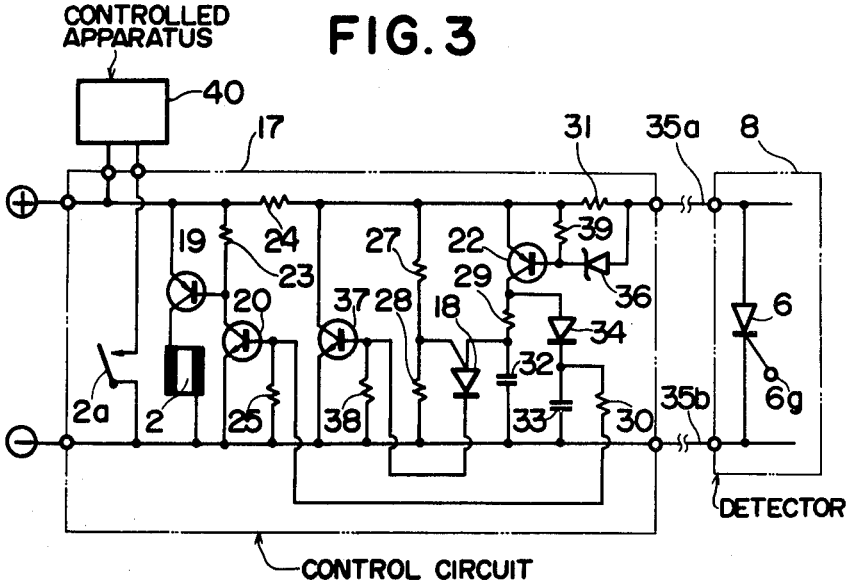

FIG. 3 shows another modification of this invention in which an emergency device 40 such as a fire alarm device or a sprinkler starter device is connected to be controlled by the contact 2*a* of the relay 2. In this embodiment, in addition to the component elements shown in FIG. 2, a transistor 37, resistors 38 and 39 and a zener diode 36 are provided.

The device shown in FIG. 3 operates as follows.

Under normal condition, all semiconductor elements are maintained OFF. When fire breaks out, the detected signal is applied to the gate electrode 6*g* of a thyristor 6 incorporated in a flame or smoke detector 8, for example an ionization type smoke detector, to turn ON the thyristor 6, with the result that current flows through resistors 24 and 31, and the thyristor 6. The voltage drop across resistor 31 turns ON transistor 22 whereby capacitors 32 and 33 are charged by the currents flowing through transistor 22 and resistor 29, and through transistor 22 and diode 34, respectively. As the capacitor 33 is charged up, its terminal voltage is impressed upon the base electrode of transistor 20 via resistor 30 thus turning ON transistor 20. Then, transistor 19 is also turned ON to energize the relay 2. Energization of the relay 2 closes its contact 2*a* to actuate the emergency device 40.

In the same manner as in the embodiment shown in FIG. 2, as the capacitor 32 is charged up to a predetermined voltage, the programmable unijunction transistor 18 is turned ON thus causing transistor 37 to become conductive. Conduction of this transistor 37 short circuits the supply circuit of the thyristor 6 and the PUT oscillator, thus rendering them nonconductive. Upon completion of the discharge of capacitor 32 through resistor 38, transistor 37 is turned OFF thus interrupting said short circuit. As long as the flame or smoke still persists, the detected signal is still impressed upon the gate electrode 6*g* so that thyristor 6 is again turned ON and the operation described above is repeated. As the relay 2 is maintained energized until termination of the discharge of capacitor 33, its contact 2*a* will not be opened during the short OFF period of the thyristor 6. In other words, the emergency device 40 is continuously operated until flame or smoke disappears. When the fire is extinguished, the detected signal to the gate electrode 6*g* is removed so that the thyristor 6 is turned OFF.

Figure 4:
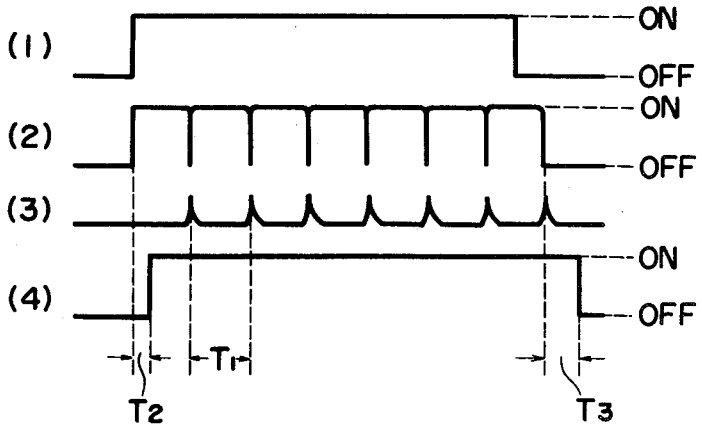
FIG. 4 shows waveforms at various portions of the circuit shown in FIG. 3.

FIG. 4 shows voltage waves of various component elements of the circuit shown in FIG. 3 in which curve (1) shows the ON-OFF states of the detected signal of the detector 8, curve (2) the ON-OFF states of the thyristor 6, curve (3) the output of the PUT oscillator and curve (4) the ON-OFF states of the relay 2. As shown the thyristor 6 is reset or turned OFF during each output pulse of short duration from the PUT oscillator and the period $T_1$ of such turning off is determined by a time constant $R_{29}.C_{32}$ which is the product of the resistance of resistor 29 and the capacitance of capacitor 32. The operation of the relay 2 lags a short delay time interval $T_2$ relative to the turning ON of the thyristor 6, the interval $T_2$ being determined by another time constant $Rd.C_{33}$ which is the product of the forward resistance Rd of diode 34 and the capacitance of capacitor 33. The delay time interval $T_3$ between the turning OFF of thyristor 6 and the opening of the contact 2*a* of the relay 2 is determined by a time constant $R_{30}.C_{33}$ which is the product of the resistance of resistor 30 and the capacitance of capacitor 33.

As described above, the invention provides a simple and reliable fire-responsive control device according to which a thyristor operated by a source of DC is turned ON only while an input signal is applied for operating a controlled apparatus. For this reason, the invention is useful for alarm devices or the like.

We claim:

1. In a fire-responsive control device of the type including a fire detector which produces a trigger signal when a change of surrounding physical phenomenon is caused by fire, a control circuit responsive to said detector, a controlled apparatus, and a DC source, the improvement in said detector comprising an output stage including a thyristor arranged to receive the trigger signal to turn on the thyristor when the detector responds to said change, said thyristor being connected in parallel with said control circuit through a pair of DC source-signal lines so as to include the switching path of said thyristor in a current path including said DC source, said control circuit comprising means for detecting a current flowing through said current path when said thyristor is turned on, an oscillator connected in parallel with said thyristor so as to begin oscillating operation when said means detects said current, first relay means arranged to periodically turn off said thyristor by an oscillating output of the oscillator, second relay means arranged to energize said controlled apparatus when said means detects said current, and delay means connected to maintain the operation of said second relay means for a predetermined interval after transient suppression of said current in said thyristor from the DC source, said controlled apparatus being connected with said control circuit so as to be energized by said second relay means while said second relay means is in operation.

2. The control device according to claim 1 wherein said means for detecting the current is connected in series with said thyristor, and wherein said oscillator and said second relay means are connected across the DC source in a parallel combination when said means detects the current flowing through said current path.

3. The control device according to claim 2 wherein said means for detecting the current comprises a first relay connected in series with said thyristor and a normally open contact of said first relay, said contact being arranged to connect said oscillator and second relay means across the DC source on the source side of said first relay when said means detects the current flowing through said current path.

4. The control device according to claim 2 wherein said means for detecting the current comprises a first resistor connected in series with said thyristor and first transistor connected to be turned on by the voltage drop across said resistor so as to connect said oscillator across the DC source through said first transistor when said first transistor is turned on, a second transistor connected to be turned on by said first transistor through said delay means when said first transistor is turned on, said second relay means being connected across the DC source through said second transistor.

5. The control device according to claim 3 wherein said first relay means comprises a second relay having a normally closed circuit and a normally open contact which are connected in a first series combination, a resistor connected between said means for detecting the current and said thyristor so as to form a second series combination with said thyristor, and a capacitor connected between the junction of said normally closed contact and said normally open contact of said second relay and the junction of said resistor and the anode electrode of said thyristor, said first series combination being connected in parallel with said second series combination so as to form a discharge circuit including said normally open contact of said second relay said first capacitor and said thyristor when said normally open contact of said second relay is closed.

6. The control device according to claim 4 wherein said first relay means comprises a third transistor which is connected in series with said means for detecting the current and said thyristor across the DC source, said third transistor being connected to periodically turn off by the oscillating output of said oscillator so as to transitorily suppress the current flowing through said thyristor from the DC source.

7. The control device according to claim 2 wherein said second relay means is connected across the DC source and energized through said delay means by said means for detecting the current when said means detects the current flowing through said current path.

8. The control device according to claim 4 wherein said delay means comprises a series circuit of a diode and a capacitor which is connected across the DC source when said means detects the current flowing through said current path, and a second resistor connected in series between a base electrode of said second transistor and the junction of said diode and said capacitor, whereby said diode is forward-biased when said means detects the current flowing through said current path and said capacitor is charged by a current flowing through said diode from the DC source so that after the suppression of current flowing through said current path, the energization of said second transistor is continued until said capacitor has discharged through said second resistor.

* * * * *